United States Patent [19]

Fujimura

[11] Patent Number: 4,727,280

[45] Date of Patent: Feb. 23, 1988

[54] SHADOW MASK FOR COLOR CATHODE RAY TUBE SHAPED TO MINIMIZE DOMING

[75] Inventor: Takeo Fujimura, Kyoto, Japan

[73] Assignee: Mitsubishi Denki Kabushiki Kaisha, Tokyo, Japan

[21] Appl. No.: 710,997

[22] Filed: Mar. 12, 1985

[30] Foreign Application Priority Data

Mar. 30, 1984 [JP] Japan ..... 59-64583
May 10, 1984 [JP] Japan ..... 59-94978

[51] Int. Cl.[4] ..... H01J 29/07
[52] U.S. Cl. ..... 313/402; 313/403
[58] Field of Search ..... 313/402, 403, 408

[56] References Cited

U.S. PATENT DOCUMENTS 3,753,663 8/1973 Black ..... 313/402 X
3,916,243 10/1975 Brown ..... 313/403
4,136,300 1/1979 Morrell ..... 313/403

FOREIGN PATENT DOCUMENTS 175238 10/1983 Japan ..... 313/407

OTHER PUBLICATIONS

"Recent Advances in Color Picture Tubes", pp. 35–37 of Advance in Image Pickup and Display, vol. 6, 1983 by Academic Press Inc.
Contoured-Line Screens for Color Picture Tubes (RCA Engineering 25-2, Aug./Sep. 1979).
A Structure Analytical Study on Shadow Mask Thermal Deformation of Color CRT (SID Japan Display '83 Report No. 1.3).
A Newly Designed Shadow Mask for Color Picture Tube (SID Japan Display '83 Report No. 1.4).

*Primary Examiner*—David K. Moore
*Assistant Examiner*—K. Wieder
*Attorney, Agent, or Firm*—Oblon, Fisher, Spivak, McClelland & Maier

[57] ABSTRACT

A shadow mask for a color cathode ray tube has grooves formed in the curved surface in such a manner that the bending strength within the plane having a larger radius of curvature becomes greater than the bending strength within the plane having a smaller radius of curvature, thereby increasing the effective radius of curvature of the curved surface.

6 Claims, 7 Drawing Figures

SHADOW MASK FOR COLOR CATHODE RAY TUBE SHAPED TO MINIMIZE DOMING

FIELD OF THE INVENTION

This invention relates to a shadow mask to be used as a color selecting mechanism in a color cathode ray tube. More particularly, the invention is concerned with a shadow mask for a color cathode ray tube, by which color difference brought about by the doming of the shadow mask is prevented.

BACKGROUND OF THE INVENTION

It has generally been known that the shadow mask type color cathode ray tube causes rise in its temperature by impingement of electron beam to bring about thermal deformation. This thermal deformation brings about color difference which is generally called "misregistration". On account of this, it has been desired that appropriate measures be taken for each cause of the thermal deformation.

As one of the causes of such heat deformation, there is a phenomenon called "doming". This is a phenomenon such that, when only a part of an image reproducing screen (a relatively large part having an area ranging from several fractions to several tens of fractions of the total effective screen area) becomes considerably bright in comparison with other part of the image reproducing screen during operation of the color cathode ray tube, and a substantially immobile image is maintained thereon over a lengthy period of time, a portion of the shadow mask corresponding to this bright portion on the image reproducing screen brings about local heat deformation.

In the following, detailed explanations will be given as to this doming phenomenon in reference to FIGS. 1A and 1B of the accompanying drawing. FIGS. 1A and 1B are schematic diagrams showing a relationship between an image reproduced on the image surface (or screen) of a color cathode ray tube and the doming phenomenon of the shadow mask. In FIG. 1A, a reference numeral 1 designates a panel with a fluorescent coating having been applied on its inner surface, and a numeral 2 refers to a shadow mask. By the way, a holding mechanism, electron guns, and other accessories for the shadow mask 2 are omitted from the illustration. On the other hand, in FIG. 1B showing an image reproduced in the screen of the color cathode ray tube, a reference numeral 10 indicates a considerably bright portion in comparison with other portions such as, for example, white clouds in the blue sky. If and when such condition continues a slightly longer period (five seconds or longer) in a substantially immobile state, a portion in the shadow mask 2 corresponding to the bright image 10 increases its temperature locally owing to much quantity of the electron beam impingement, whereby the shadow mask 2 deforms its shape from what it has primarily to be as shown by a dot line 21 to what it is shown by a solid line 22. On account of this, apertures 3 formed in the shadow mask 2 to permit passage of the electron beam can no longer maintain their constant positions. As the result of this, there is brought about deflection in quantity of irradiation on the dots of the fluorescent material, and the color difference is generated. In a general shadow mask, this heat deformation takes place in the direction where a portion of the shadow mask corresponding to the bright portion of the screen bulges out toward the fluorescent surface side. This phenomenon becomes rapidly conspicuous when the angle of deflection becomes large. This constitutes a serious problem with the recently developed color cathode ray tube having a wide angle of deflection of 110°.

The reason for such doming phenomenon to take place is that, when a part of the shadow mask 2 increases its temperature locally by impingement of the electron beam as shown in FIG. 1A and the temperature-increased portion thereof tends to expand, the surrounding part of the shadow mask 2, which has not been subjected to the electron beam impingements, does not expand. In connection with this, it has been known that, if the heated portion is circular in shape and the center part thereof represents a doming quantity in terms of a quantity W which moves perpendicularly to the surface of the shadow mask 2, the quantity W is approximately proportionate to a radius R of the spherical surface of the shadow mask, provided that the surface of the shdow mask 2 is spherical and is isotropic from the viewpoint of its mechanical strength. That is to say, it may be expressed as : $W=\alpha \cdot R$.

Derivation of the above equation is described somewhat specifically in a periodical "The Journal of the Institute of Television Engineering of Japan", Vol. 31, No. 6 (1977), pages 49 to 50, for example.

It should be noted here that the proportional constant in the above equation includes a thermal expansion coefficient of the material for the shadow mask, but constants relating to a strength against deformation such as an elastic constant of the material do not come into the proportional constant in an express form. The reason for this is considered due to the fact that the thermal deformation takes place by the dynamics between the heated portion of the shadow mask and the non-heated portion thereof surrounding the heated portion. Accordingly, so far as the neighborhood of the portion in question of the shadow mask 2 is made up of the same material, if the mechanical strength of the heated portion is high, the mechanical strength of the surrounding portion is also high with the consequence that the deformation of the shadow mask by its doming which takes place by force exerted from the surrounding region will be the same.

Now, since the doming quantity is in proportion to the radius of the spherical surface of the shadow mask, if a reciprocal 1/R of the radius R is called "a radius of curvature", the doming quantity would be in inverse proportion to the radius of curvature. Hence, the larger the radius of curvature is, the less can be made the doming quantity.

By the way, the shape of the shadow mask and mechanical strength of the material therefor are not isotropic in general. A typical example of this is a shadow mask for a color cathode ray tube having a stripe-patterned fluorescent surface. In such shadow mask, the apertures formed in its surface are long and thin, and are arranged in series in one direction, while they are arranged in a spaced apart relationship in the direction perpendicular to the abovementioned one direction, in which the apertures are arranged in series. Also, the shape of its surface is not necessarily spherical.

For the purpose of discussing this case, a normal line is erected at the point in question of the curved surface on the shadow mask 2 as shown in FIG. 2, which is made an axis Z, and then axes X and Y, which are perpendicular to this axis Z, and orthogonally intersect each other, are determined. In this connection, the direction of the axes X and Y is practically determined in relation to the arrangement of apertures in the shadow mask 2, as will be mentioned at a later paragraph; but, it needs not always be adhered to this rule in general.

Now, when the shadow mask 2 is cut along a plane X-Y, there appears a curved line at the cut face thereof. A radius of curvature of this curved line is taken as Kx, and a radius of curvature of a curved line to appear at a cut face, when the shadow mask is cut along a plane Y-Z in the same manner as mentioned in the preceding, is taken as Ky.

Upon completion of the abovementioned preparation, an equivalent radius of curvature, i.e., an effective radius of curvature, of the shadow mask 2 is considered. That is to say, in case the material for the shadow mask 2 or the shape of the surface thereof has anisotropy, a consideration is given as to the equivalent radius of curvature of the shadow mask, with which the doming is in inverse proportion. Then, from the magnitude of the equivalent radius of curvature, the magnitude of the doming is judged, on the basis of which a structure of the shadow mask having a small degree of the doming is to be found out.

In the first place, a consideration is given as to a case, wherein the material for the shadow mask 2 is isotropic and the radius of curvature thereof alone is taken up as a problem. If the shadow mask 2 has a spherical surface, Kx=Ky and this relationship should be considered equal, as it is, to the equivalent radius of curvature of the shadow mask. In the case of Kx≠Ky, the following equational relationship should be established at least approximately in consideration of the fact that a mean radius of curvature K should exist between both Kx and Ky:

$$K = \frac{Kx + Ky}{2} \tag{1}$$

Hence it can be readily inferred that the above equation denotes the equivalent radius of curvature. Incidentally, the ordinary shadow mask has its convex surface toward the panel, hence the symbols Kx and Ky are the same.

In the next place, consideration is given as to a case of the mechanical strength of the material for the shadow mask 2 having anisotropy. The term "mechanical strength" characteristic has something to do with the Young's modulus of elasticity, the flexural rigidity, and so forth of the material. In this specification, however, it is only limited to a qualitative definition and is expressed by $\sigma$, wherein consideration is given mainly on a mechanical strength corresponding to a pressure required for the center part of the material to displace by a certain very small quantity, when a pressure is applied to both ends of the long (and thin) material having a certain definite small width and a certain definite length, which can be regarded as being substantially flat and which is held vertically at its both ends in a test machine.

Now, if the material has anisotropy, this mechanical strength characteristic may be considered in two cases of the abovementioned test material being cut thin and long in parallel with the direction X from the portion in question of the shadow mask 2, and of the test material being cut thin and long in parallel with the direction Y. The mechanical strength characteristic in both cases is expressed as $\sigma$X and $\sigma$y, respectively.

When $\sigma$x and $\sigma$y are the same (i.e., in case the mechanical strength characteristic of the material is isotropic), the magnitude of the mechanical strength has no bearing on the doming quantity, and the doming phenomenon takes place in inverse proportion to the mean radius of curvature to be expressed by the above equation (1). If it is assumed that the value of $\sigma$ becomes maximum or minimum in the direction of either X or Y (in an oblique direction other than X and Y, the values do not become maximum and minimum), the doming phenomenon is observed as a sort of average of the phenomenon in both X and Y directions, which is foreseeable as a matter of course. Even if $\sigma x \neq \sigma y$, when Kx=Ky, it is nothing but strength $\sigma$ of the material having taken a certain value between $\sigma$x and $\sigma$y, whereby it can be anticipated that the doming quantity has no bearing on the mechanical strength $\sigma$. On the other hand, when Kx≠Ky and $\sigma x = \sigma y$, the above equation (1) establishes, as a matter of course, as an equation for giving an equivalent mean radius of curvature, so that the doming phenomenon has no bearing on the mechanical strength $\sigma$.

In the case of Kx≠Ky and $\sigma x \neq \sigma y$, the situation becomes different. That is to say, the degree of contribution of Kx or Ky to the mean radius of curvature increases with increased mechanical strength $\sigma$. Considering that the relationships which have so far been described, inclusive of the equation (1), should be expressed naturally, the following equation should be arrived at as the equivalent radius of curvature.

$$K = \frac{\frac{2\sigma x}{\sigma x + \sigma y} Kx + \frac{2\sigma y}{\sigma x + \sigma y} Ky}{2} = \frac{\sigma x}{\sigma x + \sigma y} Kx + \frac{\sigma y}{\sigma x + \sigma y} Ky \tag{2}$$

The substantial accuracy of this relationship can be verified by a simple experiment. This is also apparent from various literatures which have already been published, such as, for example, "A Newly Designed Shadow Mask for Color Picture Tube" (SID Japan Display '84 Report No. 1.4).

The shadow mask of the color cathode ray tube having the stripe-patterned fluorescent surface, which is taken up here as an example, is usually in the shape as shown in FIG. 3. The shadow mask 2 has a multitude of rectangular apertures 3 which are arranged in substantially parallel rows. If the longitudinal direction of the rectangular apertures 3 is taken in the Y direction, the apertures 3 are disposed in contiguity one after the other in the Y direction through a thin bridge 23, while they are disposed in the X direction at a spaced interval through a belt-shaped shadowing part 24 which is a non-permeable portion of the electron beam and has a width twice or more as broad as that of the aperture 3. The bridge 23 is a member provided for maintaining the shape of the shadow mask 2 per se, which is an unnecessary portion from the standpoint of the operational principle of the color selection and is said to be better if it is as thin as possible from the viewpoint of brightness characteristic of the color cathode ray tube. On account of this portion being thin, the afore-mentioned mechanical strength characteristic $\sigma$X of the shadow mask 2 is considerably smaller than y. Accordingly, the shadow mask used in a television receiving set and is generally considered to have its mechanical strength relationship of $\sigma x : \sigma y = 3 : 7$, or so. By the way, the strength $\sigma$ other than in the directions X and Y takes a mean value between $\sigma x$ and $\sigma y$.

On the other hand, the radii of curvature Kx and Ky at each portion of the shadow mask 2 are determined by the shape of the inner surface of the panel 1, the space intervals among the apertures 3, and the positional relationship among the electron guns (not shown in the drawing), which are generally composed of plural numbers. With the recently developed color cathode ray tube, both Kx and Ky are not constant over the entire surface of the shadow mask, but are in a relationship of $Kx \neq Ky$.

Now, in the shadow mask 2 shown in FIG. 3, since $\sigma x < \sigma y$ as already mentioned in the foregoing, if $Kx < Ky$, a larger value of Ky would remarkably affect the equivalent radius of curvature K based on the above equation (2) with the consequence that the value of K can be made relatively large. However, if $Kx > Ky$, the especially large value of Kx does not affect so much on the value of K, because $\sigma x$ is relatively small in comparison with $\sigma y$, with the consequence that the value of K is limited to a small value by a relatively small value of Ky.

Although it may be preferable, if the value of Ky can always be made greater than Kx, as there are very many constants relevant to deteremination of the geometrical radius of curvature, it is usual that the value cannot be determined freely. In particular, with the recently developed color cathode ray tube, the major axis direction of the panel in a usually rectangular shape is roughly coincident with the direction X in FIG. 3. However, since the radius of curvature of the inner surface of the panel is in most cases determined by various external factors so that the portion of the panel, on which the fluorescent surface is to be provided, may appear as flat as possible, attempts have been made as to remarkably reducing the radius of curvature of the panel in its Y direction at the end of the X direction. On account of this, the radius of curvature Ky of the shadow mask in the Y direction, which is to be determined with a certain relationship being maintained with the inner surface of the panel, should in most cases be forcibly made small (even in this case, Kx is possibly set at a fairly large value).

Accordingly, the conventional shadow mask is forced to have the relationship of $Kx > Ky$ and $\sigma x < \sigma y$, with the consequence that the value of the mean radius of curvature K becomes small. On account of this, the doming quantity increases to disadvantageously bring about the color difference.

Furthermore, in recent years, it has become a general practice to make the inner surface of the panel 1 to have a relatively complicated curviform so that the external appearance of the panel 1 of the color image receiving tube may appear as flat as possible. As the result of this, the curved surface of the shadow mask 2 to be determined in relation to the shape of the inner surface of the panel 1 becomes also complicated, and the shadow mask having the radius of curvature thereof having the relationship of $Kx < Ky$ at least in one part thereof comes to be used. As described in the foregoing, the relationship of $\sigma x < \sigma y$ at such portion in the shadow mask effectively increases the equivalent radius of curvature and reduces the doming phenomenon. Therefor, the shadow mask 2 having the rectangular apertures 3, as shown in FIG. 3, has already satisfied the relationship of $\sigma x < \sigma y$. If it is further possible to make this difference larger, the doming phenomenon can be much more reduced by more effective utilization of the relationship of $Kx < Ky$.

OBJECTS OF THE INVENTION

In view of the various disadvantages inherent in the conventional shadow mask for the color cathode ray tube, it is the primary object of the present invention to provide a shadow mask for the color cathode ray tube which is capable of reducing a doming quantity to suppress color difference and to thereby improve the image quality by forming grooves in the surface of the shadow mask in such a manner that, when the radii of curvature to appear in the two directions at the cross-sections of the shadow mask plane are different from each other, the mechanical strength of the shadow mask within the plane thereof having a larger radius of curvature may be greater than the mechanical strength in the other plane thereof; and by increasing an equivalent radius of curvature to be determined by these two radii of curvature and two mechanical strength characteristics.

SUMMARY OF THE INVENTION

According to the present invention, in general aspect of it, there is provided a shadow mask for a color cathode ray tube having a curved surface which is convex toward the inner surface of a panel where a fluoresceht surface is formed, and having a multitude of apertures, through which electron beam passes, the radius of curvature to appear at the cross-section of the curved surface in two directions being different each other, characterized in that grooves are formed in said curved surface in such a manner that a bending strength within the plane having a larger radius of curvature becomes greater than the bending strength within the plane having a smaller radius of curvature, thereby increasing an effective radius of curvature of said curved surface.

The above object, and still other objects, and advantages, specific construction, and features of the present invention will become more apparent and understandable from consideration of the following detailed description thereof, especially when read in conjunction with the accompanying drawings which illustrate the invention schematically and form a part of this specification.

DETAILED DESCRIPTION OF THE PRESENTLY PREFERRED EMBODIMENTS

In the following, the present invention will be described in greater details with reference to the specific embodiments shown in the accompanying drawing.

Figures 1A, 1B:
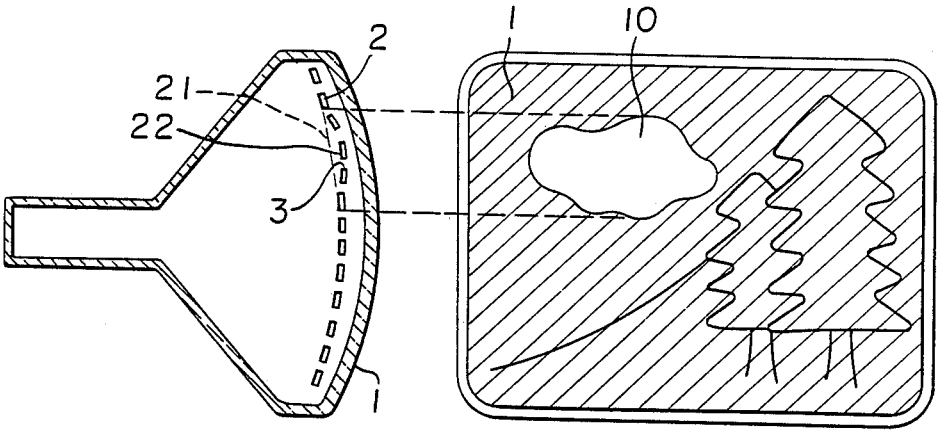
FIGS. 1A and 1B are schematic diagrams for explaining the doming phenomenon in a shadow mask type color cathode ray tube.
Figure 2:
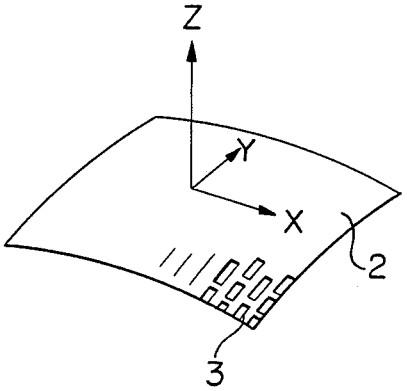
FIG. 2 is a schematic perspective view for explaining a coordinate system in the shadow mask.
Figure 3:
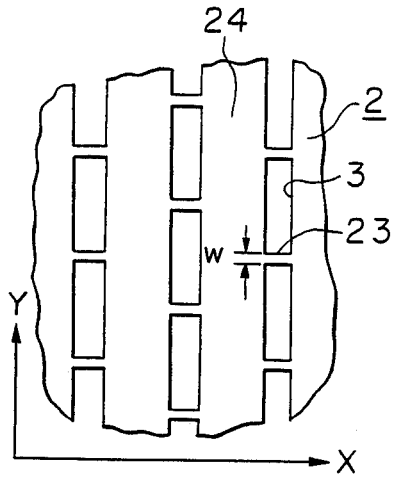
FIG. 3 is a partly enlarged plan view showing a conventional shadow mask.
Figure 4:
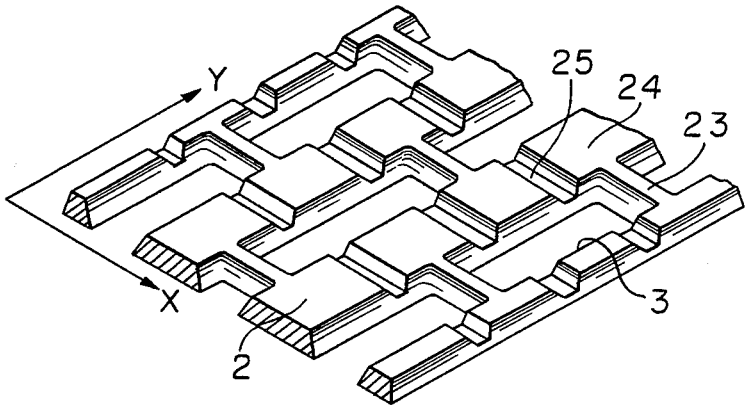
FIG. 4 is a partly enlarged perspective view showing the first embodiment of the shadow mask according to the present inventions.

FIG. 4 illustrates the first embodiment of the shadow mask 2 for the color cathode ray tube according to the present invention. In this figure of drawing, the arrangement of the apertures 3 is the same as the arrangement of FIG. 3 with the exception that groove-shaped thin thickness portions 25 are formed in the shadowing parts 24 in the direction perpendicular to the longitudinal direction of the apertures 3 (i.e., in the X direction), which is the characteristic of the this embodiment. The thin thickness portion 25 is provided at a position slightly distant from a junction of the bridge 23 and the shadowing part 24, the width of the thin thickness portion 25 being substantially the same as the original thickness of the mask plate. At this portion, the plate thickness of the shadowing part 24 is made thin over the entire width thereof so as to be $\frac{2}{3}$ to $\frac{1}{4}$ of the original plate thickness.

Where such thin thickness portion 25 is formed in the shadowing part 24, the mechanical strength $\sigma y$ thereof is apparently small in comparison with a case where such thin thickness portion 25 is not existent, as will be seen from consideration of readiness of its bending where such thin thickness portion is formed. On the other hand, the mechanical strength $\sigma x$ almost does not change if the thin thickness portion 25 has sufficiently narrow width. Accordingly, if $Kx > Ky$, the equivalent radius of curvature K can be made larger, by formation of the thin thickness portion 25 and in connection with the equation (2), than in the case where the thin thickness portion 25 is not present, whereby the doming phenomenon can be reduced.

As one example, when $Kx = 1/1100 \text{ mm} = 0.00091 \text{ mm}^{-1}$ $Ky = 1/1800 \text{ mm} = 0.00056 \text{ mm}^{-1}$ if the thin thickness portion 25 is non-existent, K will be as follows, from the equation (2), provided $\sigma x : \sigma y = 3 : 7$.

$$K = \frac{3}{3+7} \times 0.00091 + \frac{7}{3+7} \times 0.00056$$

$$= 0.00067 \text{ mm}^{-1}$$

In contrast to this, if the mechanical strength $\sigma x$ and $\sigma y$ are in a relationship of $\sigma x : \sigma oy = 6 : 4$, K will be as follows, from the equation (2).

$$K = \frac{6}{6+4} \times 0.00091 + \frac{4}{6+4} \times 0.00056$$

$$= 0.00077 \text{ mm}^{-1}$$

Since the doming is in inverse proportion to the equivalent radius of curvature, the doming quantity becomes $0.00067/0.00077 = 0.87$, whereby a reduction by 13% in the doming quantity can be expected.

By the way, in the above-described embodiment, the thin thickness portion 25 is formed in a groove-shape, which is desirable from the standpoint of not reducing the mechanical strength $\sigma x$ and of facilitating the press-forming of the curved surface.

The embodiment of the thin thickness portion 25 according to the present invention, wherein Kx is greater than Ky, is not limited to that shown in FIG. 4. For instance, the number of the thin thickness portions 25 may be much more than the apertures 3, or much less than the apertures. Similarly, it is not necessary that the thin thickness portions 25 be arranged relative to all the apertures 3 in the same positional relationship. Further, the thin thickness portion 25 may be provided on the rear surface of the shadow mask 2, or on both the front and the rear surfaces thereof.

Further, the present invention can be applied to a shadow mask in which a multitude of circular holes are arranged at an equal space interval, provided that the radii of curvature Kx and Ky of the shadow mask are different. In this case, the axes X and Y should be so selected that the radii of curvature Kx and Ky may take the maximum and minimum values, respectively. In addition, the non-apertured part between the adjacent holes should all be regarded as the shadowing part.

Figure 5:
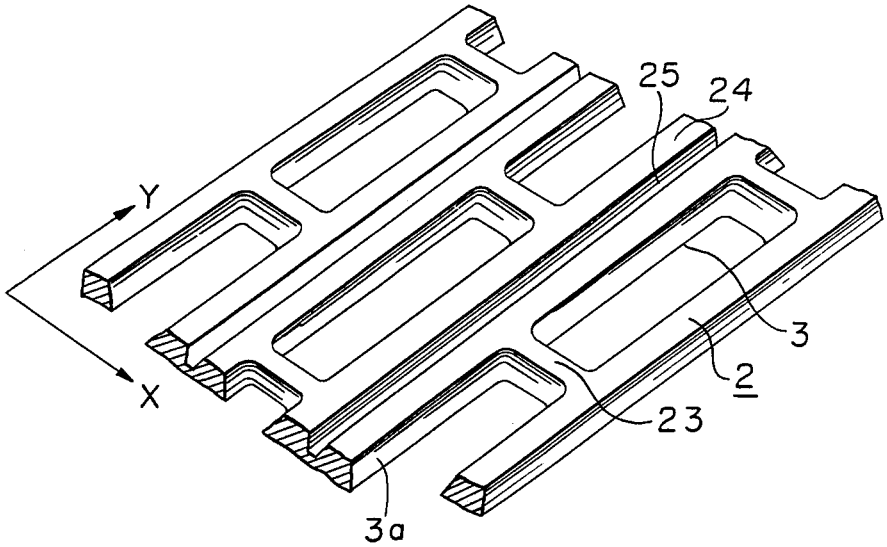
FIG. 5 is a partly enlarged perspective view showing the second embodiment of the shadow mask according to the present invention.

FIG. 5 illustrates the shadow mask 2 of a second embodiment of the present invention. Since the shadow mask 2 has a plate thickness, it is illustrated in exaggeration so as to enable readers to understand the situation. It should be noted that the arrangement of apertures 3 in this figure is the same as that of FIG. 3.

In this embodiment, the shadowing parts 24 have grooves 25 formed therein. The groove 25 is a thin thickness portion of a narrow width, which is formed at and along the substantial center of the shadowing part 24 extending in the Y direction. The width of the groove is made about $\frac{2}{3}0$ to $\frac{1}{4}$ of the width of the shadowing part 24 at its open end part thereof, and its depth is made about $\frac{3}{4}$ to $\frac{1}{4}$ of the original plate thickness. When such groove 25 is formed, both $\sigma x$ and $\sigma y$ become small in comparison with the case where such groove is not formed, as will be apparently inferred upon consideration of readiness of its bending, although $\sigma x$ becomes smaller than $\sigma y$ in ratio. Conversely speaking, $\sigma y$ becomes larger than $\sigma x$ in ratio. Accordingly, if $Kx < Ky$, the equivalent radius of curvature K can be made large thereby, as already mentioned in the foregoing, and hence the doming quantity can be made small. Concretely speaking, in the case of :

$Kx = 1/1800 \text{ mm} = 0.00056 \text{ mm}^{-1}$ $Ky = 1/900 \text{ mm} = 0.00112 \text{ mm}^{-1}$ if it is assumed that the shadowing part 24 remains as it has been conventionally, and $\sigma x : \sigma y = 3 : 7$, the value of K will be as follows on the basis of the equation (2).

$$K = \frac{3}{3+7} \times 0.00056 + \frac{7}{3+7} \times 0.00112$$

$$\approx 0.00095 \text{ mm}^{-1}$$

In contrast to this, if it is assumed that the ratio between $\sigma x$ and $\sigma y$, varies due to formation of the groove 25 in the shadowing part 24 as in this embodiment, whereby the ratio has become $\sigma x : \sigma y = 1.5 : 8.5$, the value of K will be as follows on the basis of the equation (2).

$$K = \frac{1.5}{1.5+8.5} \times 0.00056 + \frac{8.5}{1.5+8.5} \times 0.00112$$

$$\approx 0.00104 \text{ mm}^{-1}$$

Since the doming is in inverse proportion to the equivalent radius of curvature, the doming quantitiy becomes $0.00095/0.00104 \approx 0.91$, whereby about 9% of reduction (improvement) in the doming can be expected.

The effect to be derived from this embodiment as described above is to devise the shape of the thin portion of the shadow mask so that the ratio of $\sigma x$ to $\sigma y$ may be relatively small at the portion where the relationship of $Kx<Ky$ is established. Such relationship between $\sigma x$ and $\sigma y$ can also be achieved by, for example, reducing the width and the thickness of the bridge 23, or providing a thin thickness portion in different shapes. However, a reduction in the width and the thickness of the bridge 23 would make the bridge 23 much weaker in strength. However, the bridge 23 is generally manufactured in the narrowest possible width to increase the electron beam permeability, and hence the bridge 23 is already at or near the limit of its mechanical strength. Accordingly, a reduction in the width or the thickness of the bridge 23 would bring about side-effects of increased difficulty in forming the curved surface of the shadow mask; increased possibility of deformation of the curved surface in the course of manufacturing the color image receiving tube; and other adverse side-effects. Further, when the groove or something like that at the thin thickness portion 25 comes closer to the side wall 3*a* of the aperture 3, it becomes no longer possible to form the aperture 3 in its accurate shape, with the consequence that such inaccuracy in the shape of the aperture would appear on the screen as an irregularity in the reproduced image. On account of these, such expedients do not surpass this second embodiment of the present invention, in which a simple groove 25 is formed in the shadowing part 24 without its coming closer to the side wall 3*a* of the aperture 3.

When putting this embodiment into practice, the groove 25 may not always be continuous over the entire width in the direction Y of the shadow mask 2, but such groove 25 may be non-continuous, leaving the original thick portion of the shadowing part 24 from place to place.

Figure 6:
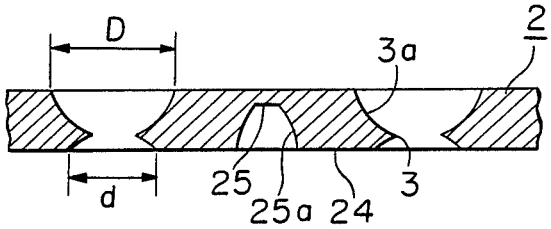
FIG. 6 is a cross-sectional view, in part, showing a preferred structure of the second embodiment in FIG. 5.

Incidentally, with the shadow mask in general, the side wall 3*a* of the aperture 3 is not vertical to the surface of the material plate, but it is given a considerable inclination. In more detail, the sizes of the aperture at both open end parts in the surface of the material plate are different each from other as designated by reference letters D and d in FIG. 6. As the consequence of this, the cross-sectional shape of the shadowing part 24 in the X direction is substatially trapezoidal. While the groove 25 is usually formed by etching the material plate, as the groove increases its depth, the side wall 25*a* of the groove 25 is forced to have an inclination to gradually narrow its width, in this case. Even in such case, in order to obtain the effect of the groove 25 to both $\sigma x$ and $\sigma y$ (the effect to reduce the value of $\sigma x$ as small as possible without impairing $\sigma y$ as far as possible) to the maximum possible extent, it is effective to form the groove 25 from the side of the material plate where the open diameter of the aperture 3 is small (the side designated by d in FIG. 6).

Although the invention has been described with reference to particular embodiments thereof, it will be understood by those persons skilled in the art that the invention is capable of a variety of alternative embodiments without departing from the spirit and scope of the invention as recited in the appended claims.

I claim:

1. An aperture mask having a plurality of openings therein for the projection of an electron beam therethrough, said aperture mask comprising a sheet;

(a) having a curved surface in a convex form;

(b) having an aperture region defined by a plurality of at least generally rectangular openings therethrough;

(c) said plurality of at least generally rectangular openings comprising a plurality of rows of openings located in substantial alignment in their longitudinal directions to thereby from a plurality of at least substantially parallel spaced rows of openings;

(d) each of said plurality of at least generally rectangular openings being elongated in the direction of said rows of openings;

(e) each adjacent pair of said plurality of at least generally rectangular openings in each of said plurality of rows of openings being separated by a thin bridge;

(f) each adjacent pair of said plurality of spaced rows of openings being separated by a shadowing part;

(g) a plurality of thin thickness portions extending across each of said shadowing parts perpendicularly to the direction of said rows of openings;

(h) said plurality of at least generally rectangular openings all having substantialy the same width and length;

(i) said plurality of at least generally rectangular openings in each adjacent pair of said plurality of spaced rows of openings being offset from one another such that the thin bridges between each adjacent pair of openings in one row of openings is at the level of the midpoints of the openings in the adjacent row of openings;

(j) two of said plurality of thin thickness portions communicating with each one of said plurality of at least generally rectangular openings in a first one of said adjacent pair of said plurality of spaced rows of openings and each one of said two of said plurality of thin thickness portions communicating with a different one of said plurality of at least generally rectangular openings in the second one of said adjacent pair of said plurality of spaced rows of openings; and (k) said thin thickness portions being formed on the curved surface having a relation that $K_x$ is larger than $K_y$, wherein:

(i) $K_x$ is a the curvature of the curved surface in cross section when the curved surface is cut along a normal line in the direction perpendicular to said rows of openings;

(ii) $K_y$ is a curvature of the curved surface in cross section when the curved surface is cut along a normal line in the direction in parallel to said rows of openings; and (iii) a curvature in a given direction is the reciprocal 1/R of the radius of the surface of the shadow mask in that direction.

2. An apparatus mask as recited in claim 1 wherein said sheet has a substantially uniform thickness apart from said at least generally rectangular openings and said thin thickness portions.

3. An aperture mask as recited in claim 2 wherein the thickness of said thin thickness portions is between $\frac{1}{4}$ and $\frac{2}{3}$ the thickness of said sheet.

4. An aperture mask having a plurality of openings therein for the projection of an electron beam therethrough, said aperture mask comprising a sheet:

(a) having a curved surface in a convex form;

(b) having an aperture region defind by a plurality of at least generally rectangular openings therethrough;

(c) said plurality of at least generally rectangular openings comprising a plurality of rows of openings located in substantial alignment in their longitudinal directions to thereby form a plurality of at least substantially parallel spaced rows of openings;

(d) each of said plurality of at least generally rectangular openings being elongated in the direction of said rows of openings;

(e) each adjacent pair of said plurality of at least generally rectangular openings in each of said plurality of rows of openings being separated by a thin bridge;

(f) each adjacent pair of said plurality of spaced rows of openings being separated by a shadowing part;

(g) a plurality of thin thickness portions extending in parallel to the longitudinal direction of said shadowing parts; and (h) said thin thickness portions being formed on the curved surface having a relation that $K_x$ is smaller than $K_y$, wherein:

(i) $K_x$ is a curvature of the curved surface in cross section when the curved surface is cut along a normal line in the direction perpendicular to said rows of openings;

(ii) $K_y$ is a curvature of the curved surface in cross section when the curved surface is cut along a normal line in the direction in parallel to said rows of openings; and (iii) a curvature in a given direction is the reciprocal 1/R of the radius of the surface of the shadow mask in that direction.

5. An aperture mask as recited in claim 4 wherein said sheet has a substantially uniform thickness apart from said at least generally rectangular openings and said thin thickness portions.

6. An aperture mask as recited in claim 5 wherein the thickness of said thin thickness portions is between $\frac{1}{4}$ and $\frac{2}{3}$ the thickness of said sheet.

* * * * *